US011053719B2

(12) United States Patent
Gosling et al.

(10) Patent No.: US 11,053,719 B2
(45) Date of Patent: Jul. 6, 2021

(54) DOOR TRACK AND CEILING SUSPENSION SYSTEMS AND METHODS

(71) Applicant: DIRTT Environmental Solutions, Ltd., Calgary (CA)

(72) Inventors: Geoff W. Gosling, Calgary (CA); Thomas Brown, Calgary (CA)

(73) Assignee: DIRTT ENVIRONMENTAL SOLUTIONS LTD., Calgary (CA)

( * ) Notice: Subject to any disclaimer, the term of this patent is extended or adjusted under 35 U.S.C. 154(b) by 0 days.

(21) Appl. No.: 16/477,788

(22) PCT Filed: Jun. 1, 2018

(86) PCT No.: PCT/US2018/035690

§ 371 (c)(1),
(2) Date: Jul. 12, 2019

(87) PCT Pub. No.: WO2019/013901

PCT Pub. Date: Jan. 17, 2019

(65) Prior Publication Data

US 2020/0123826 A1 Apr. 23, 2020

Related U.S. Application Data

(60) Provisional application No. 62/531,750, filed on Jul. 12, 2017.

(51) Int. Cl.
*E05D 15/06* (2006.01)

(52) U.S. Cl.
CPC ..... *E05D 15/0652* (2013.01); *E05Y 2201/11* (2013.01); *E05Y 2600/41* (2013.01)

(58) Field of Classification Search
CPC ..... E05Y 2201/11; E05Y 2600/41; E05D 15/0652
See application file for complete search history.

(56) References Cited

U.S. PATENT DOCUMENTS 3,783,930 A 1/1974 Williams
3,886,685 A * 6/1975 Riphagen ..... E05D 15/565 49/209
4,073,034 A * 2/1978 Martens ..... E05D 15/06 16/87 B (Continued)

FOREIGN PATENT DOCUMENTS

DE 19757122 A1 6/1999
EP 2366856 A2 9/2011

OTHER PUBLICATIONS

International Search Report and Written Opinion dated Jan. 18, 2019 from International Patent Application No. PCT/US2018/035690, filed Jun. 1, 2018.

*Primary Examiner* — Victor D Batson
*Assistant Examiner* — Matthew J Sullivan
(74) *Attorney, Agent, or Firm* — Workman Nydegger

(57) ABSTRACT

A system for mounting sliding doors within a wall assembly and suspending a ceiling. The system includes a mounting assembly mounted above the suspended ceiling and out of sight. A sliding door extends through a slit between the wall and the ceiling and connects to the mounting assembly. A shroud encases the mounting assembly to block light, airflow and sound from passing through the slit in the ceiling.

19 Claims, 12 Drawing Sheets

(56) References Cited

U.S. PATENT DOCUMENTS

| | | | | |
|---|---|---|---|---|
| 5,121,782 | A * | 6/1992 | Renkhoff | E04F 10/0618 160/22 |
| 5,283,978 | A * | 2/1994 | Horgan, Jr. | E05D 5/0246 49/388 |
| 6,026,612 | A * | 2/2000 | Strassel | E05D 15/0669 16/100 |
| 6,516,566 | B2 * | 2/2003 | Finke | E05D 15/0652 49/127 |
| 7,424,935 | B1 * | 9/2008 | Smith | B66B 13/30 187/333 |
| 8,316,914 | B2 * | 11/2012 | Bell | E05D 15/0652 160/199 |
| 2015/0259962 | A1 * | 9/2015 | Chang | E05D 15/0626 49/404 |
| 2019/0169898 | A1 * | 6/2019 | Kawulka | E05D 15/08 |
| 2020/0123826 | A1 | 4/2020 | Gosling et al. | |

* cited by examiner

DOOR TRACK AND CEILING SUSPENSION SYSTEMS AND METHODS

CROSS-REFERENCE TO RELATED APPLICATIONS

This application is a national stage of International Patent Application No. PCT/US2018/035690 filed on Jun. 1, 2018, which claims the benefit of U.S. Provisional Application No. 62/531,750, filed Jul. 12, 2017. The entire content of each of the aforementioned patent applications is incorporated herein by reference.

BACKGROUND

1. The Field

Implementations of the present disclosure relate generally to sliding doors and suspended ceilings. More specifically, the present disclosure relates to assemblies and methods for mounting door tracks and suspended ceilings.

2. The Relevant Technology

Office space can be relatively expensive, not only due to the basic costs of the location and size of the office space, but also due to any construction needed to configure the office space in a particular way. Furthermore, as an organization's needs change, it is often necessary to have a convenient and efficient means to reconfigure the existing office space rather than having to move to a new office space. Many organizations address their configuration and reconfiguration issues by dividing large, open office spaces into individual work areas using modular walls and partitions because they can be relatively easy to configure, less expensive to set up, and reconfigured more easily than more permanently constructed office dividers. Manufacturers or designers typically design such modular walls and partitions to include a series of individual wall modules (and/or panels) that can be assembled together to form a range of different configurations.

In addition, one will appreciate that many modular wall partitions will need to implement a closure apparatus, such as a door. Doors provide a convenient way to enter and exit spaces as well as to selectively open and close entrances to such spaces. Of course, there are many types of doors from which to choose. In some cases, a manufacturer or designer will opt for a conventional swinging door, while in other cases, the manufacturer might opt for a sliding door configuration, such as for space saving purposes. While sliding doors may provide space saving advantages compared to a swinging door, sliding doors also pose various problems. For instance, sliding doors typically include a track or mounting assembly mounted on the outside of a wall and below a suspended ceiling, which can be aesthetically unpleasing. Sliding doors and the associated mounting hardware often allow for light and sound to pass between adjacent spaces defined by the sliding door. Additionally, separate systems are typically required to mount a sliding door track and to install a suspended ceiling, which can increase costs and the complexity of an installation.

Accordingly, there are a number of disadvantages in the art of sliding door tracks and suspended ceilings that can be addressed.

BRIEF SUMMARY

The present disclosure relates to wall systems that include sliding doors and suspended ceilings. More specifically, the present disclosure relates to assemblies for mounting sliding doors and suspended ceilings in an aesthetically pleasing manner. For instance, the sliding door mounting systems described herein are disposed above a suspended ceiling and the sliding doors extend above the suspended ceiling. Positioning the mounting systems above the ceiling and having the door extend into the ceiling allows for a minimalistic aesthetic. The mounting assemblies can also include a shroud that encases the other components of the mounting assembly. The shroud can block light, sound and/or air flow from passing through the opening in the ceiling through which the door extends. Blocking light can minimize the view of the mounting assembly by individuals near the door. Additionally, blocking sound can increase privacy and eliminate distractions. Additionally, blocking airflow can reduce the flow of dust or smoke and reduce transmission of contaminants from room to room. Furthermore, the suspended ceiling can be mounted to the sliding door mounting system.

According to one example implementation, a system for mounting sliding doors within a wall system includes a connection component defining a first accessory channel A track is secured to the connection component via a cantilever arm that extends into the first accessory channel. A roller is associated with the track. A roller bracket is connected between the roller and a sliding door. A shroud encases the track, roller, and roller bracket to block light and sound. The connection component, track, roller, and roller bracket are disposable above a modular ceiling of the wall system.

BRIEF DESCRIPTION OF THE DRAWINGS

In order to describe the manner in which the above-recited and other advantages and features of the invention can be obtained, a more particular description of the invention briefly described above will be rendered by reference to specific implementations and/or embodiments thereof which are illustrated in the appended drawings. Understanding that these drawings depict only typical implementations and/or embodiments of the invention and are not therefore to be considered to be limiting of its scope, the invention will be described and explained with additional specificity and detail through the use of the accompanying drawings in which.

DETAILED DESCRIPTION

The present disclosure relates to wall systems that include sliding doors and suspended ceilings. More specifically, the present disclosure relates to assemblies for mounting sliding doors and suspended ceilings in an aesthetically pleasing manner. For instance, the sliding door mounting systems described herein are disposed above a ceiling and the sliding doors extend into the ceiling, positioning the mounting systems above the ceiling and having the door extend into the ceiling allows for a minimalistic aesthetic. The mounting assemblies can also include a shroud that encases the other components of the mounting assembly. The shroud can block light and/or sound from passing through the opening in the ceiling through which the door extends.

Blocking light can minimize the view of the mounting assembly for individuals near the door and blocking sound can increase privacy and eliminate distractions. Additionally, blocking airflow can reduce the flow of dust or smoke and reduce the transmission of contaminants from room to room. Furthermore, the suspended ceiling can be connected to the sliding door mounting system to suspend the ceiling. In implementations of modular wall systems that do not include ceilings, the shroud improves the aesthetic appearance of the mounting system by hiding the various components thereof, providing a clean and simple appearance to the system.

According to one example implementation, a system for mounting sliding doors and a suspended ceiling within a wall system includes a connection component defining a first accessory channel A track is secured to the connection component via a cantilever arm that extends into the first accessory channel A roller is associated with the track. A roller bracket is connected between the roller and a sliding door. The connection component is also configured to have a suspended ceiling connected thereto such that the connection component, the track, the roller, and the roller bracket are positioned vertically above the suspended ceiling. A shroud encases the track, roller, and roller bracket to block light and sound. The connection component, track, roller, and roller bracket are disposable above a modular ceiling of the reconfigurable wall system.

Figure 1A:
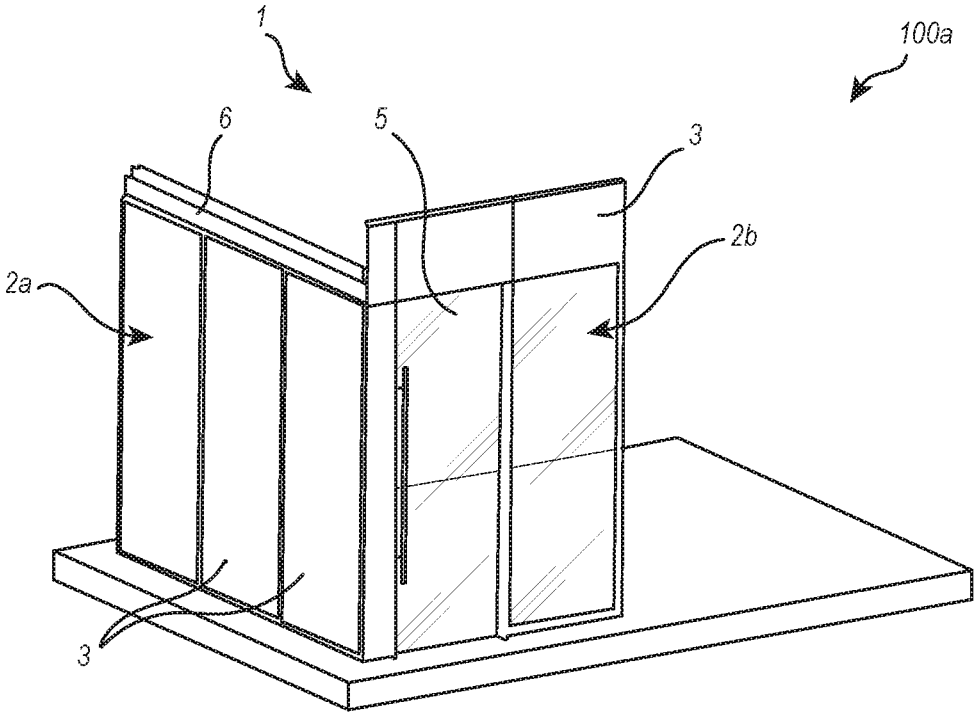
FIG. 1A illustrates a perspective view of a wall system including a single room.

Referring now to the Figures, FIG. 1A illustrates an outside view of a modular wall system 100*a* including a single room 1. The room 1 includes elements necessary to construct one of a plurality of repeating rooms 1 in a multi-room and/or office space system. The room 1 may include at least two walls 2*a*, 2*b*, which may be modular walls or (existing) structural walls.

The walls 2*a*, 2*b* may include a combination of various wall panels/tiles 3, and/or doors 5. The doors 5 illustrated in the Figures, including FIG. 1A, are frameless glass doors. However, in one or more other embodiments, the door 5 may be another type of door, such as a framed door and/or one made of materials other than glass. In the illustrated embodiment, the door 5 may be a sliding door 5 incorporated into the room 1 to allow entry into the room 1 and exit from the room 1. The room 1 may also include one or more beams 6 disposed above wall 2*a* and or wall 2*b*.

Figure 1B:
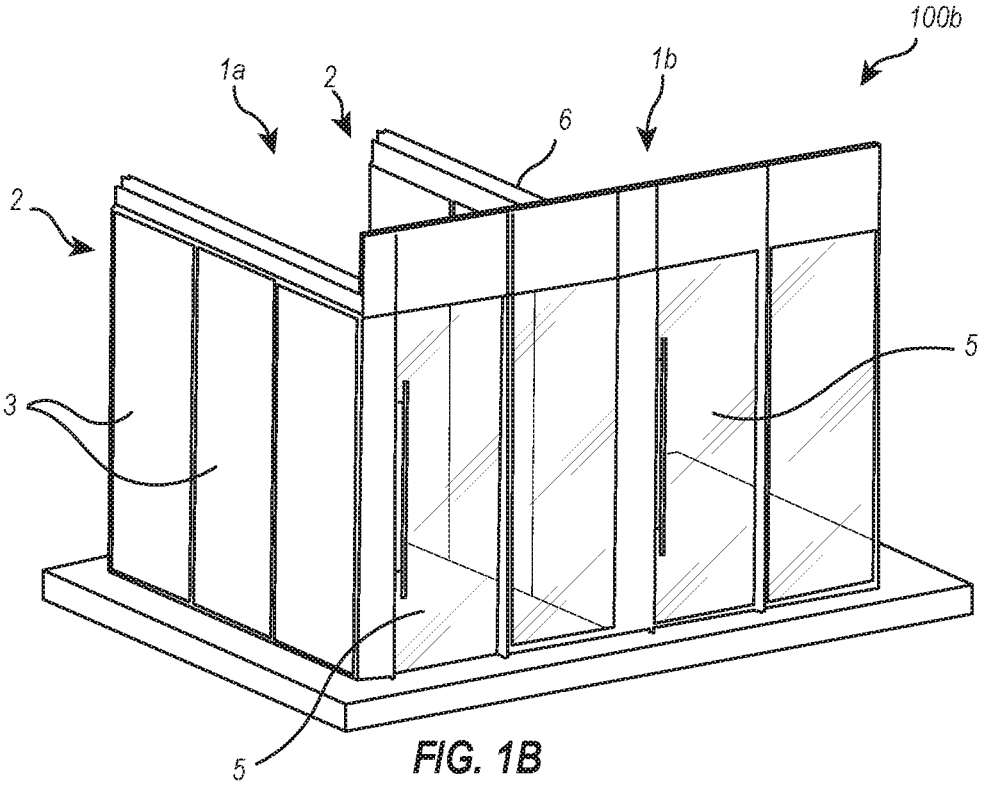
FIG. 1B illustrates a perspective view of a wall system including multiple rooms.

FIG. 1B illustrates a modular wall system 100*b* including two rooms 1*a*, 1*b*, each substantially similar to the room 1 illustrated in FIG. 1A, which an installer can configure to form a system of two or more modular rooms. In the illustrated embodiment, the rooms 1*a*, 1*b* share a common wall 2 and/or beam 6 that separate the rooms 1*a*, 1*b*. In this way, an installer can construct a plurality of adjacent rooms to provide, for example, office spaces. One of skill in the art will appreciate that a designer or installer can provide or construct any number of combinations and configurations of a modular system of rooms in this manner. The sizes, shapes, and/or number of rooms 1*a*, 1*b* can vary from one implementation to another, by varying the number and/or location of walls 2, panels 3, and/or doors 5 or other openings.

Figure 2A:
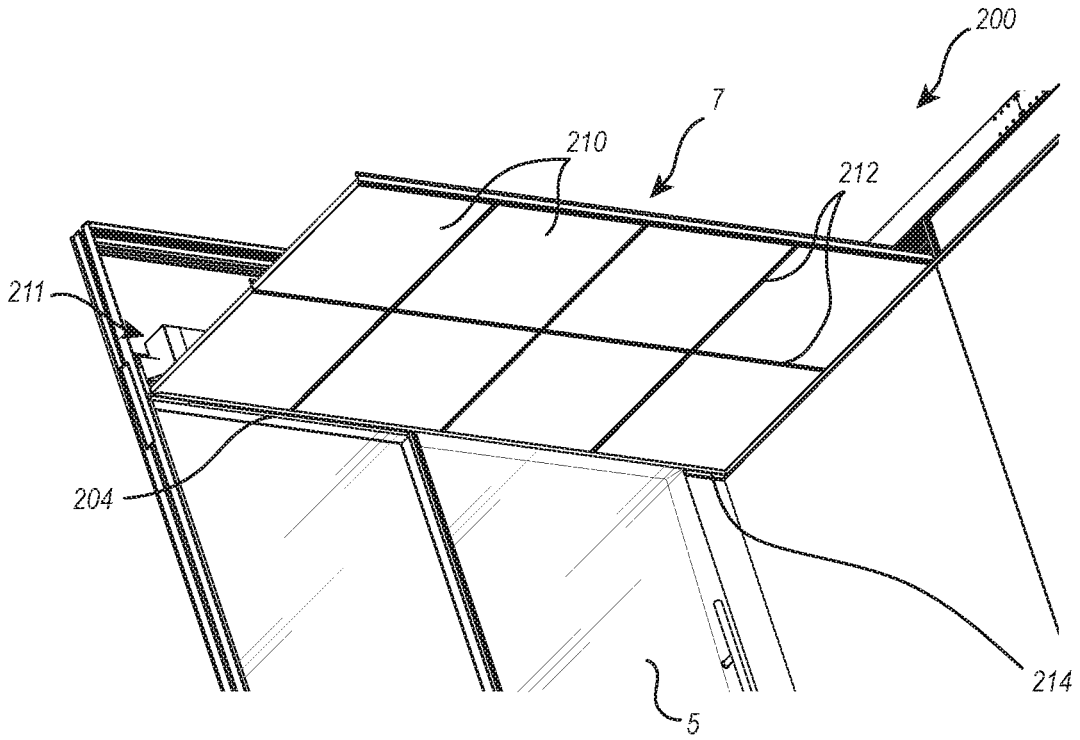
FIG. 2A illustrates a perspective view of a wall system including a sliding door mounting assembly.

FIG. 2A illustrates an inside perspective view of an embodiment of a system of modular walls 200 according to the present disclosure. The system 200 includes a modular ceiling 7, a sliding door 5, and a system for mounting a sliding door 5 within the modular ceiling 7. The system for mounting a sliding door 5 within the modular ceiling comprises a mounting assembly 211. The mounting assembly 211 resides above the ceiling 7 and out of sight, so as to provide a more aesthetically pleasing doorway. The mounting assembly 211 engages the sliding door 5 above the ceiling 7. As a result, the ceiling 7 helps to hide the engagement between the sliding door 5 and the mounting assembly 211 from a viewpoint below the ceiling 7. The sliding door 5 extends from below the ceiling 7 to above the ceiling 7 through a slit opening 204 in the ceiling 7. As discussed in more detail below, the ceiling 7 is also mounted to the mounting assembly 211 to suspend the edge of the ceiling 7 from the walls supporting the sliding door. One will appreciate that one or more other implementations of modular wall systems may not include a ceiling.

In the illustrated embodiment of FIG. 2A, the modular ceiling 7 spans at least two of the walls 2. As alluded to above, a system as described herein may include one or more modular walls and/or one or more existing structural walls. A ceiling, such as the ceiling 7, may span one or more modular walls, one or more existing structural walls, and/or both modular and existing structural walls. The ceiling 7 includes various ceiling tiles 210. One or more ceiling tile beams 212 and/or support rails 214 support the ceiling tiles 210. The one or more support rails 214 also support the ceiling tile beams 212.

Figure 2B:
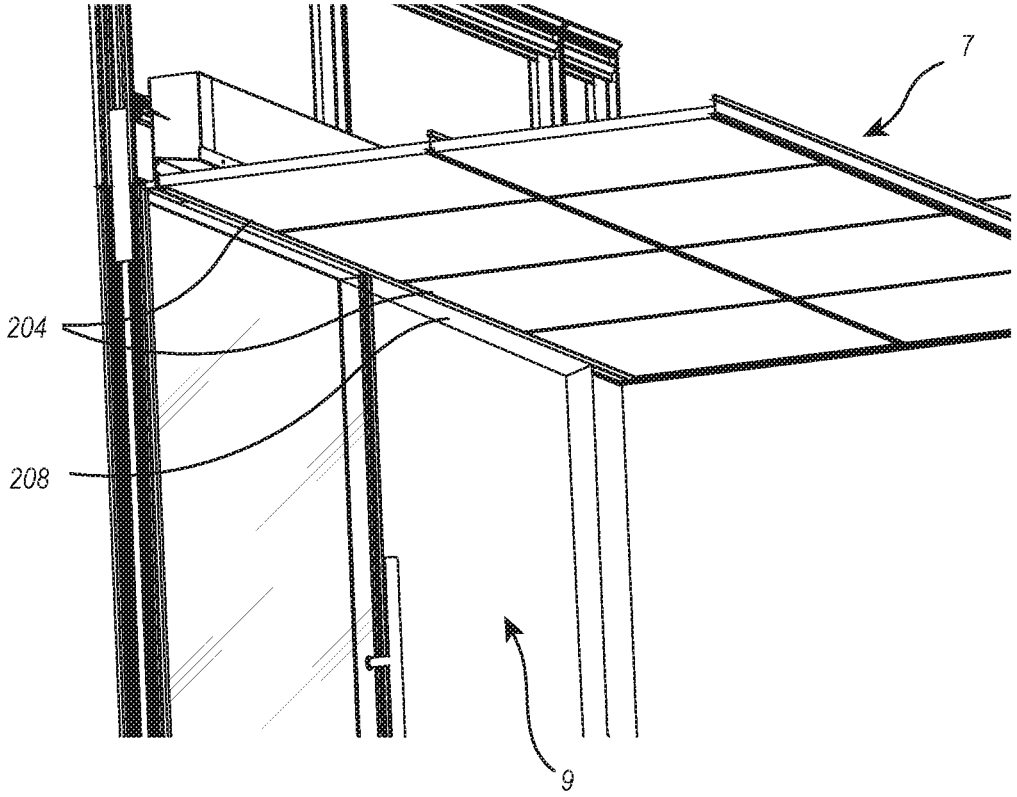
FIG. 2B illustrates a perspective view of a wall system including a sliding door mounting assembly.

FIG. 2B illustrates a view of system 200 similar to that of FIG. 2A, except the door 5 is open, thereby revealing a door opening 9, a door-opening header module 208, and a slit opening 204 between the ceiling 7 and the door-opening header module 208. As can be seen in FIG. 2B, the door 5 extends through the slit opening 204 so as to be able to engage the mounting system 211 above the ceiling 7.

A manufacturer or designer can design the mounting system 211 to limit the amount of light and sound that can pass through the slit opening 204 and into the space(s) defined by the door 5. Limiting the amount of light that can pass through the slit opening 204 can limit the visibility of the mounting assembly 211 and provide a more aesthetically pleasing transition between the ceiling 7 and the door-opening header module 208. Similarly, limiting the amount of sound that can pass through the slit opening 204 can provide greater privacy and reduce distractions between adjacent spaces.

FIG. 2B also illustrates the spatial relationship between the ceiling 7 and the door-opening header module 204. As can be seen, an installer has mounted the ceiling 7 and the door-opening header module 204 so they are spaced apart from one another to define the slit opening 204. As can also be seen, the installer has mounted the ceiling 7 and the door-opening header module 204 so that the bottom or lower surfaces thereof are substantially flush or co-planar with one another. The flush or co-planar arrangement between ceiling 7 and the door-assembly header module 204 provides an aesthetically pleasing appearance.

Figure 3A:
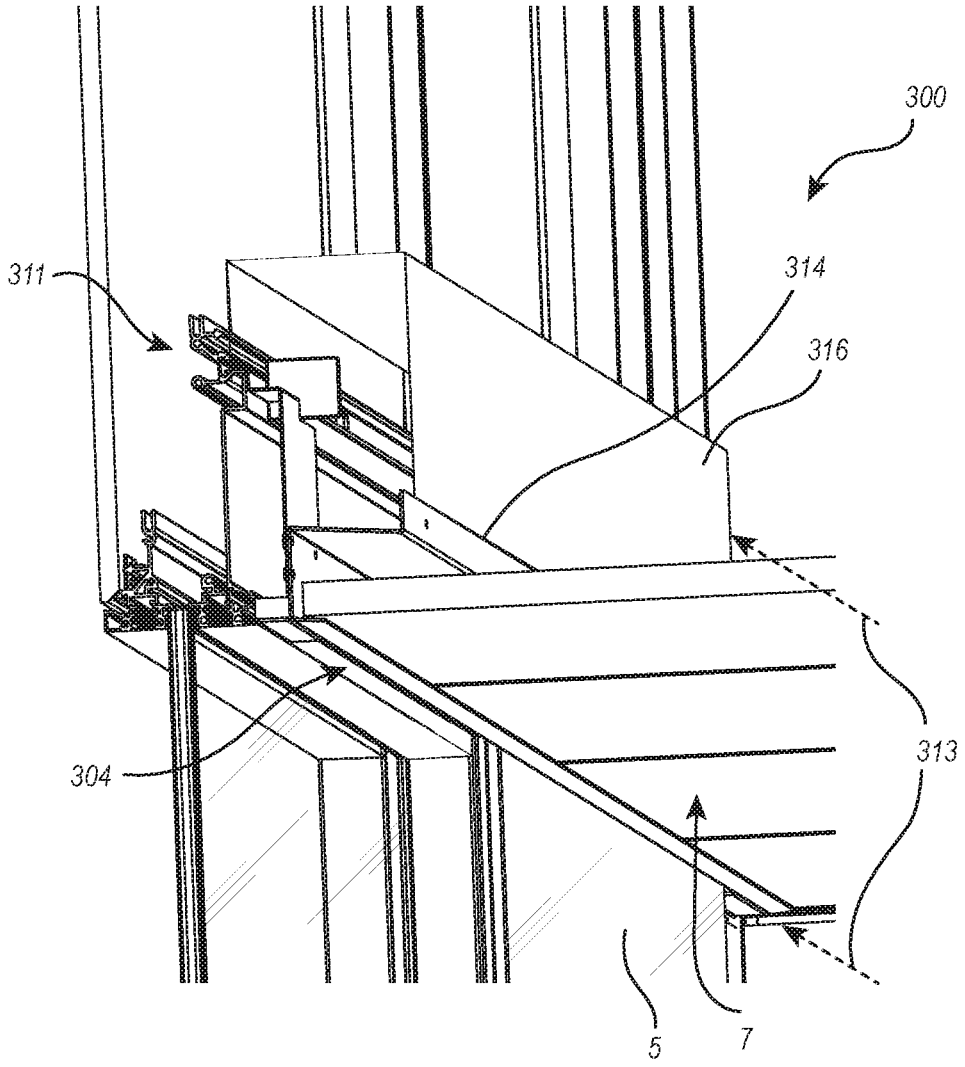
FIG. 3A illustrates a perspective view of an embodiment of a mounting assembly disposed above a modular ceiling.
Figure 3B:
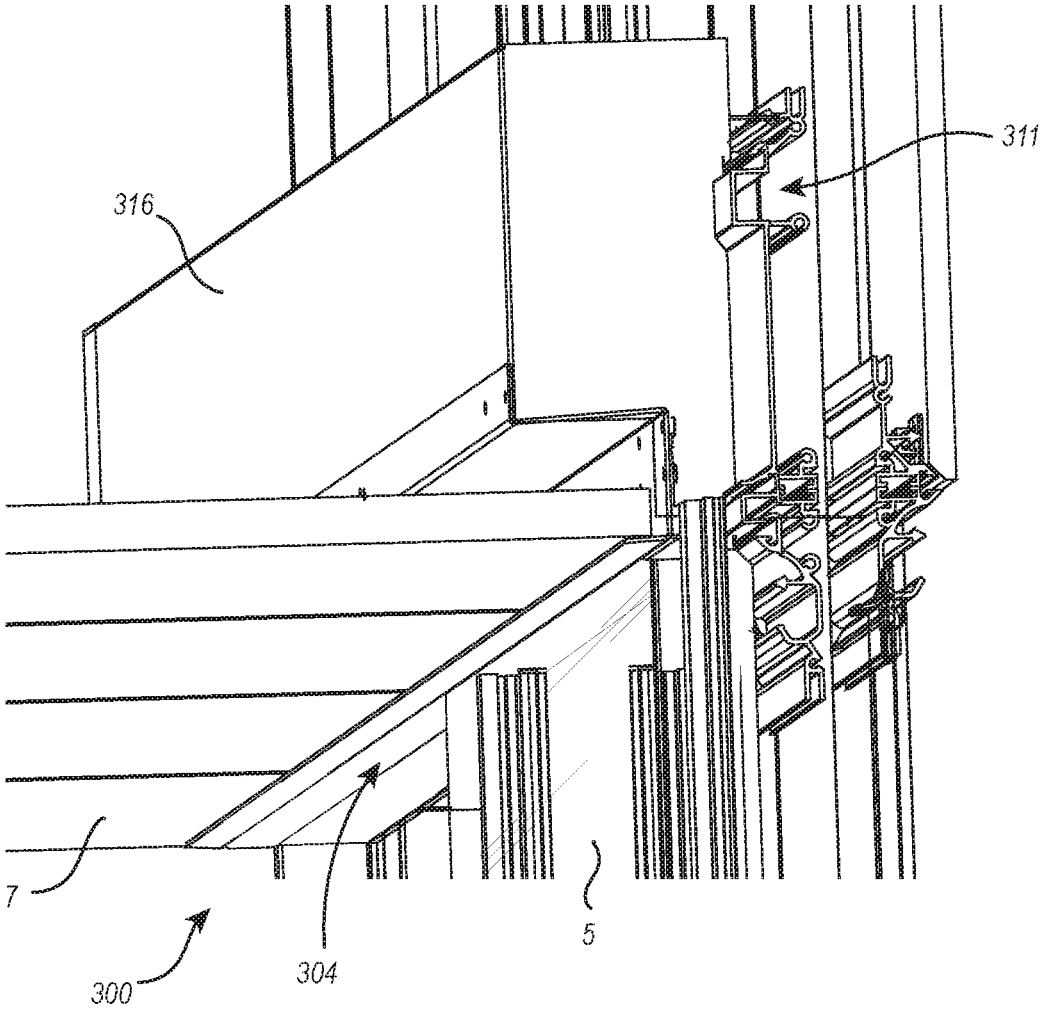
FIG. 3B illustrates a perspective view of an embodiment of a mounting assembly disposed above a modular ceiling.

FIGS. 3A and 3B illustrate perspective views of an embodiment of a modular wall system 300 including mounting assembly 311 residing above a ceiling 7. A sliding door 5 extends through a slit opening 304 and engages and/or interacts with the mounting assembly 311. The mounting assembly 311 extends along a length 313 substantially with the slit opening 304. In other embodiments, the mounting assembly 311 may be longer or shorter than the slit opening 304. In the illustrated embodiment, the mounting assembly 311 includes a shroud 316. The shroud 316 is a rectangular prism and substantially covers other components of the mounting assembly 311.

Other embodiments may include a shroud 316 of different shapes and/or sizes to accommodate various embodiments of mounting assemblies 311 described herein. For example, the shroud may be circular, triangular, or polygonal in shape and/or cover only some portions of the mounting assembly 311. The shroud 316 may encapsulate other components of the mounting assembly 311 in order to block light and/or sound from above the ceiling from traveling through the slit opening 304 through which the sliding door 5 extends.

Also, as noted above, in implementations with modular wall systems that do not include a ceiling, the shroud improves the aesthetic appearance of the mounting system by hiding the various components thereof, providing a clean and simple appearance to the mounting assembly and/or modular wall system. The shroud 316 therefore may aid in concealing the mounting assembly 311, blocking a view of the mounting assembly 311 through the slit opening 304 of someone present within the room or other space created by the modular wall system. This may have the effect of a more aesthetically pleasing modular system, and particularly a more aesthetically pleasing doorway.

In addition to blocking light and/or sound, the shroud 316 can also be used to suspend the ceiling 7. For instance, as can be seen in FIGS. 3A and 3B, an upper portion of the shroud 316 can be connected (e.g., with fasteners (screws, bolts, adhesives, etc.) interlocking connection features, etc.) to an upper portion of the mounting assembly 311. A support rail 314 can be connected to a lower end of the shroud 316. The support rail 314 can use the ceiling 7 connected thereto, such that the ceiling is suspended from the shroud 316 and the mounting assembly 311.

Figure 4:
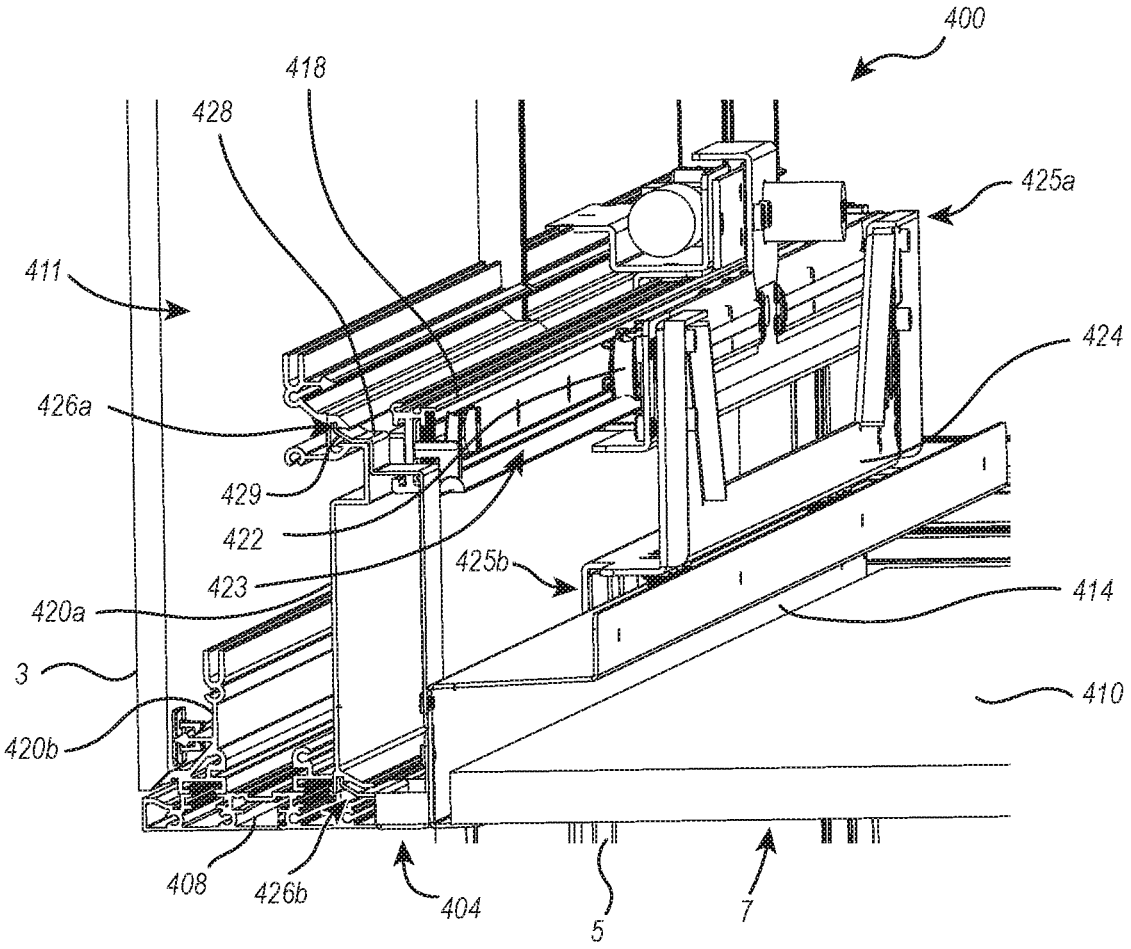
FIG. 4 illustrates a perspective view of an embodiment of a mounting assembly disposed above a modular ceiling.

FIG. 4 illustrates a cross-sectional perspective view of an embodiment of a modular wall system 400 that includes mounting assembly 411 residing above a ceiling 7. FIG. 4 does not illustrate a shroud 316 as illustrated in FIGS. 3A and 3B. Some embodiments of the mountings assembly 411 may or may not include a shroud 316.

The illustrated mounting assembly 411 includes a connection component 420*a*, a track 418, a roller 422, a roller bracket 424, and a sliding door 5. The track 418 extends lengthwise along the mounting assembly 411. Other embodiments of the mounting assembly 411 include a track 418 that is longer or shorter than the track 411 illustrated in FIG. 4.

Figure 6:
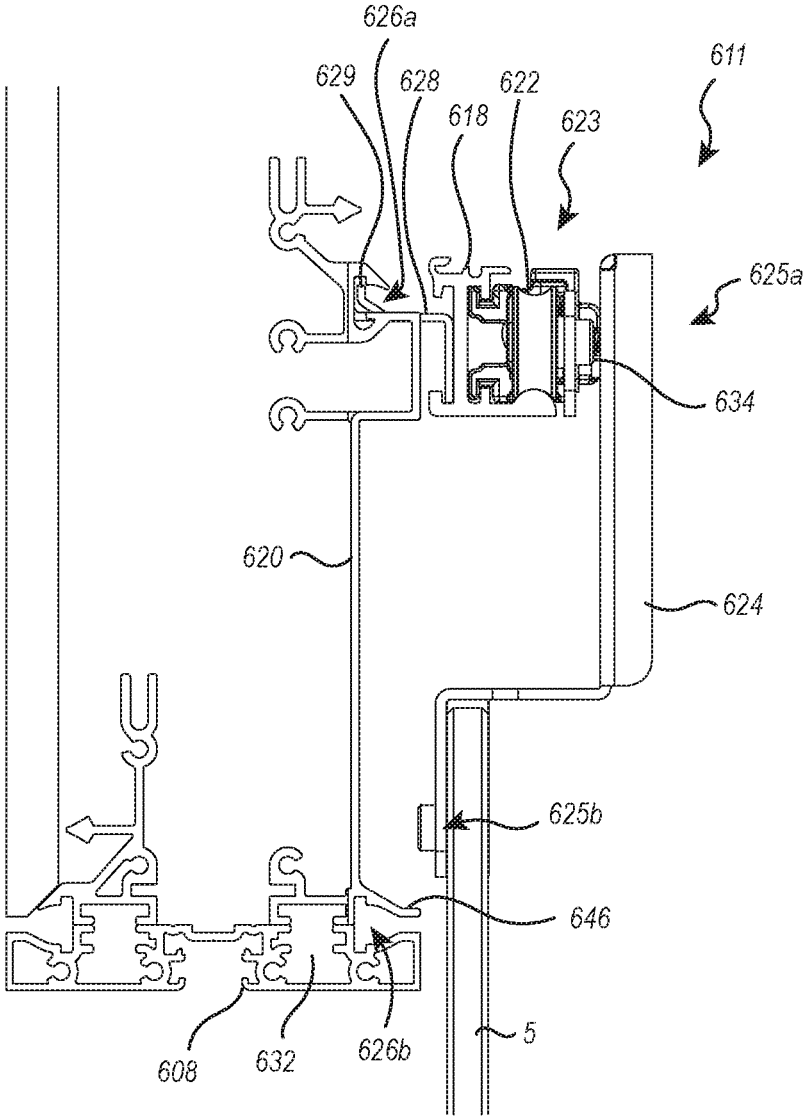
FIG. 6 illustrates a cross-sectional view of an embodiment of a mounting assembly.

A track connection bracket 428 connects the track 418 to the connection component 420*a*. The track connection bracket 428 includes a cantilever arm 429 that extends into a first accessory channel 426*a* on connection component 420*a*. FIGS. 6 through 7B and the associated discussion below provides a more detailed description of example accessory channels 426*a*, 426*b*. The cantilever arm 429 of the track connection bracket 428 secures the track connection bracket 428 to the connection component 420*a*. An installer can secure the track 418 to the track connection bracket 428 using one or more of a number of methods. These methods may include, but are not limited to, adhesives, welding, bolts, clips, press fitting, screws, and the like.

In other embodiments, the mounting assembly 411 may not include a track connection bracket 428. For example, the track 418 may include a cantilever arm 429 integrally formed with the track 418 so that it is not a separate piece. An installer may secure the track 418 itself directly to the connection component 420*a* via the cantilever arm 429 extending into the accessory channel 426*a*. The present disclosure also contemplates other single or multiple component tracks 418 and/or track connection brackets 428. Also, while FIG. 4 illustrates an embodiment that includes a single track 418, other embodiments of a mounting assembly 411 may include more than one track 418 arranged in parallel, coaxially aligned, or both.

The cross-sectional contours of the track 418 provide a roller channel 423 that accommodates a roller 422 therein. The specific cross-sectional shape of the track 418 may vary depending on the roller 422 disposed therein and/or depending on the size and/or shape of the associated connection component 420*a*. The roller 422 may be concave in cross section and conform to the contours of the roller channel 423 so that it may travel in either direction along the length of the track 418 while remaining disposed within the roller channel 423. One or more rollers 422 may be included in the mounting assembly 411.

An installer can connect the roller bracket 424 to the track 418 at a first end 425*a* of the roller bracket 424. Similarly, an installer can connect the roller bracket 424 to the sliding door 5 at a second end 425*b* of the roller bracket 424. A manufacturer may form the second end 425*b* of the roller bracket 424 as one component integral to the roller bracket 424 or as one or more pieces that are connectable to the rest of the roller bracket 424.

A manufacturer or installer may shape and/or position the roller bracket 424 so as to position the sliding door 5 within the slit opening 404 between the ceiling 7 and the door-opening header module 408. An installer may connect the roller bracket 424 to the sliding door 5 using one or more of a number of methods. These methods may include, but are not limited to, adhesives, press fitting, clamps, clips, bolts, screws, nails, or the like. The cross-sectional shape and/or contour of the roller bracket 424 may vary from the cross-sectional shape illustrated in FIG. 4. The cross-sectional shape may depend on the position of the one or more rollers 423 and/or tracks 418 relative to the slit opening 404.

The slit opening 404 between the ceiling 7 and the door-opening header module 408 allows the sliding door 5 to extend from below the ceiling 7 and to the roller bracket 424 above the ceiling 7. The door-opening header module 408 and the ceiling 7 may lie substantially flush with each other across the slit opening 404.

A support rail 414 supports the ceiling 7, ceiling tiles 410, and/or other ceiling components. An installer can connect the support rail 414 to the connection component 420*a* (e.g., directly or via a shroud as discussed above). An installer can connect the roller bracket 424 (e.g., an upper portion thereof) to the track 418. In turn, the installer can connect the tract 418 to the connection component 420 and a cantilever arm 429 as shown. For instance, the installer can insert a first portion of the cantilever arm 429 within a slot in the track 418 and a second portion of the cantilever arm 429 into the first accessory channel 426*a* of the connection component 420.

In the illustrated embodiment of FIG. 4, an installer can connect the door-opening header module 408 to one or more of the connection brackets 420*a*, 420*b*. As noted elsewhere, the bottom surface of the door-opening header module 408 lies substantially flush or co-planar with the bottom surface of the support rail 414 and/or ceiling tile 410 supported thereon. An installer can also connect a panel/tile 3 to the connection components 420*b* above the door-opening header module 408.

Figure 5:
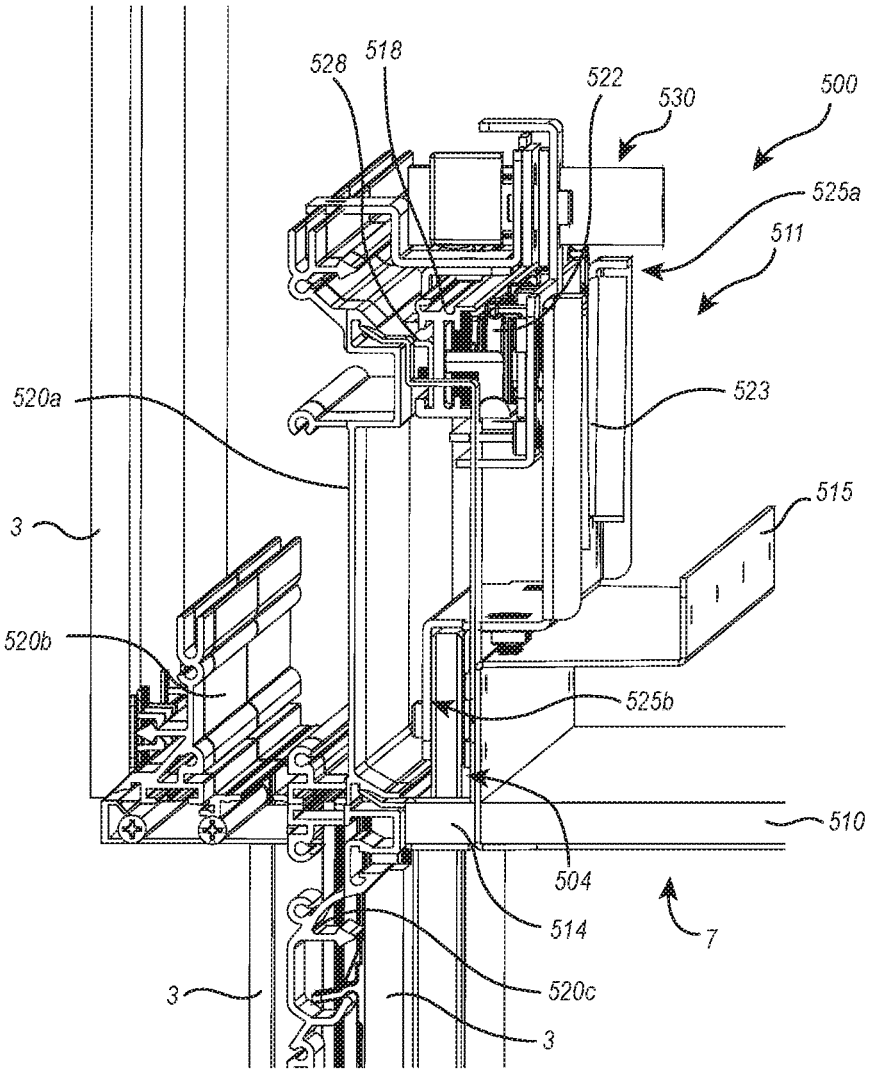
FIG. 5 illustrates a perspective view of an embodiment of a mounting assembly disposed above a modular ceiling.

FIG. 5 illustrates an embodiment of a mounting assembly 511 disposed above a modular ceiling 7. FIG. 5 also illustrates other components of a modular wall system 500, including various connection components 520*a*, 520*b*, 520*c*, wall panels/tiles 3, and various modular ceiling components. FIG. 5 shows the system 500 without a shroud in order to illustrate other components of the assembly 511. However, an installer may include a shroud to encase the mounting assembly 511 and block light and/or sound from traveling through the slit opening 504 and/or to connect the ceiling 7 to the connection component 520*a*.

The mounting assembly 511 of FIG. 5 includes a connection component 520*a*, a track 518, a roller 522, a roller bracket 523, and a track connection bracket 528. The mounting assembly 511 also includes a lock assembly 530 that locks the sliding door in place. The lock assembly 530 may also be hidden above the ceiling 7 within the shroud, such as shroud 316 illustrated in FIGS. 3A and 3B. In addition, other components may also be included and hidden above the ceiling 7 and within a shroud. For example, in one embodiment, a motor assembly may be included that is configured to automatically move the sliding door 5 along the track by manipulating the roller bracket 523 and/or roller 522 to which the motor 530 is connected.

The connection component 520*a*, track 518, roller 522, and roller bracket 523 are similar to those illustrated in FIG. 4. The roller bracket 523 illustrated in FIG. 5 is a single component that connects to the roller 522 at a first end 525*a* and to the sliding door 5 at a second end 525*b*. The second end 525*b* is a single, integral component that secures the sliding door 5 to the roller bracket 523 (e.g., via one or more methods including press fitting, welding, screws, bolts, adhesives, or the like). The roller bracket 523 illustrated in FIG. 5, as well as other roller brackets illustrated in the figures, may be only one of a plurality of roller brackets included in the mounting assembly 511. For example, the mounting assembly may include two separate roller brackets 523 disposed at either end of the mounting assembly, or at a middle of the assembly 511, and so forth. The one or more roller brackets 523 may only connect to the one or more sliding doors 5 at certain discrete locations on the sliding door 5. In other embodiments, one or more roller brackets may connect to and/or contact the sliding door 5 along an entire length of the sliding door 5.

The mounting assembly 511 includes a support rail 514, which supports one or more ceiling tiles 510 and/or other modular ceiling 7 components. An installer can connect the support rail 514 to the connection component 520*a* in the same way as described in reference to the other support rails described herein. The support rail 514 may include an extension 515 that extends up and around a portion of the roller bracket 524 and may be configured to also support a shroud (not illustrated). An installer may connect a shroud (e.g., similar or identical to shroud 316) to at least partially enclose the mounting assembly 511 and/or to secure the support rail 514 to the connection component 520*a*.

FIG. 6 illustrates a cross-sectional view of at least a portion of a mounting assembly 611. The mounting assembly 611 includes a connection component 620, a track 618, a track connection bracket 628, a roller 622, a roller bracket 624, a sliding door 5, a connection interface component 632, and a door-opening header module 608. The track connection bracket 628 secures the track 618 to the connection component 620. The track connection bracket 628 includes a cantilever arm 629 that extends into a first accessory channel 626*a* in the connection component 620. The cantilever arm 629 may press against the contours of the connection component 620 or the first accessory channel 626*a* thereof to connect the track 618 to the connection component 620. The track 618 also includes a slot that receives a portion of the track connection bracket 628, which secures the track connection bracket 628 to the track 618. In other embodiments, the fasteners may secure the track 618 and the track connection bracket 628 together. In other embodiments, a manufacturer may integrally form the cantilever arm 629 and the track 618.

As noted, the track 618 may have a roller channel 623 configured to house a roller 622. The roller 622 may be shaped to compliment the contour of the roller channel 623 in order to roll along a length of the roller channel 623 without coming (laterally) out of the roller channel 623. Therefore, the size, shape, and/or contours of the roller 622 and roller channel 623 may vary depending on the size shape of each component. The illustrated embodiment includes a single roller 622 and a single track 618. Other embodiments may include more than one track 618, roller channels 623, and/or rollers 622. Furthermore, a single track 618 may include more than one roller channels 623 and a single roller channel 623 may accommodate more than one roller 622 side by side, in series, and/or both.

A manufacturer or installer may rigidly connect the roller bracket 624 to the roller 622 at a first end 625*a* of the roller bracket 624. Similarly, a manufacturer or installer may rigidly connect the roller bracket 624 to the sliding door 5 at a second end 625*b* of the roller bracket 624. When a user opens or closes the door 5, the roller 622 moves along the length of the roller channel 623. A bearing 634 may connect the roller bracket 624 to the roller 622 (e.g., at the first end 625*a* of the roller bracket 624). The bearing 634 may be a ball bearing or other bearing configured to allow the roller 622 to rotate within the roller channel 623 without rotating the roller bracket 624. In this way, the sliding door 5 may travel linearly within the slit opening (not illustrated in FIG. 6) as the roller 622 rotates and travels linearly within the roller channel 623.

The connection or association between the roller bracket 624 and the door 5 may be similar or the same as such other connections described herein. The illustrated embodiment of FIG. 6 includes a roller bracket 624 with the second end 625*b* configured to hold the sliding door 5 on both sides. The illustrated roller bracket 624 is one continuous component. Other embodiments may include rolling brackets 624 made up of multiple components. A manufacturer or design may form, shape, or configure the roller bracket 624 so that it positions the sliding door 5 within the slit opening (not shown in FIG. 6) as shown in reference to other embodiments herein.

As illustrated in FIG. 6, a connection interface component 632 connects the door-opening header module 608 to the connection component 620. The door-opening header module 608 and the connection component 620 may cooperate to define a second accessory channel 626*b*. An extension arm 646 extends from the connection component 620 and partially defines the second accessory channel 626*b*. An installer or user may use the second accessory channel 626*b* to secure various other accessories and/or components therein, including a support rail (not shown) to support modular ceiling components as illustrated in other embodiments described herein.

In addition to the implementations of systems illustrated in FIGS. 4 through 6, FIG. 7A illustrates a perspective view of an embodiment of a modular wall system 700 that includes mounting assembly 711 residing above a ceiling 7. For illustrative purposes, FIG. 7 does not show a shroud 316 as illustrated in FIGS. 3A and 3B. Some embodiments of the mountings assembly 711 may or may not include a shroud 316. The illustrated mounting assembly 711 includes first and second connection components 720*a*, 720*b*, a track 718, first and second rollers 722*a*, 722*b*, a roller bracket 723, and a door 5.

A manufacturer may connect the first and second connection components 720*a*, 720*b* at respective attachment interfaces using an interface element 724*a*, as shown. In addition, the manufacturer can attach the track 718 to the first connection component 720*a* at first and second accessory channels 726*a*, 726*b*. The first and second accessory channels 726*a*, 726*b* are formed from the extruded contours of the connection component 720*a*. The track 718 includes first and second arms 729*a*, 729*b* that a manufacturer can insert into the first and second accessory channels 726*a*, 726*b* to secure the track 718 to the first connection component 720*a*.

Additionally, the first connection component 720*a* can be secured to a second connection component 720*b* at another attachment interface via a second interface component 724*b*. One will appreciate that a manufacturer can build any number of combinations of connection components that are secured together at attachment interfaces using interface components 724*a*, 724*b* as shown. That is, any of the embodiments of connection components described herein may be combined together to form a desired wall system that suits the needs of the end-user or particular requirement and/or dimensions of a room.

Turning back to FIG. 7A, the implementation of the track 718 shown includes first and second roller channels 721*a*, 721*b*. The roller channels 721*a*, 721*b* are configured to accommodate first and second rollers 722*a*, 722*b* therein. The rollers 722*a*, 722*b* are rotatably connected to a roller bracket 723 that also connects to the door 5. For example, the first end 725*a* of the roller bracket connects to the rollers 721*a*, 721*b* and the second portion 725*b* of the roller bracket 723 connects to the door 5. In this way, the door 5 may be slid back and forth when the rollers 721*a*, 721*b* roll back and forth within the roller channels 721*a*, 721*b*, respectively.

Figure 7A:
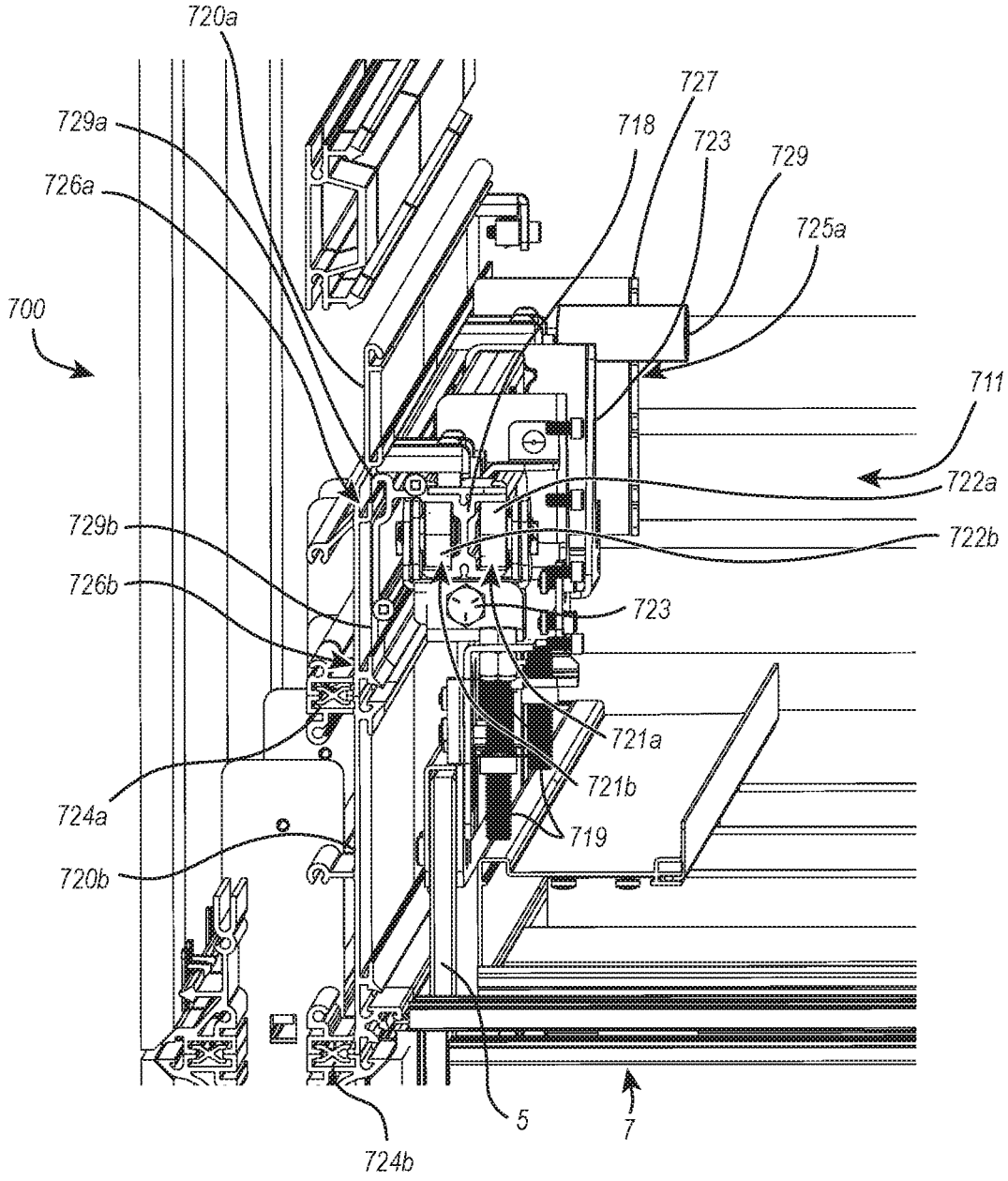
FIG. 7A illustrates a perspective view of an embodiment of a mounting assembly disposed above a modular ceiling.
Figure 7B:
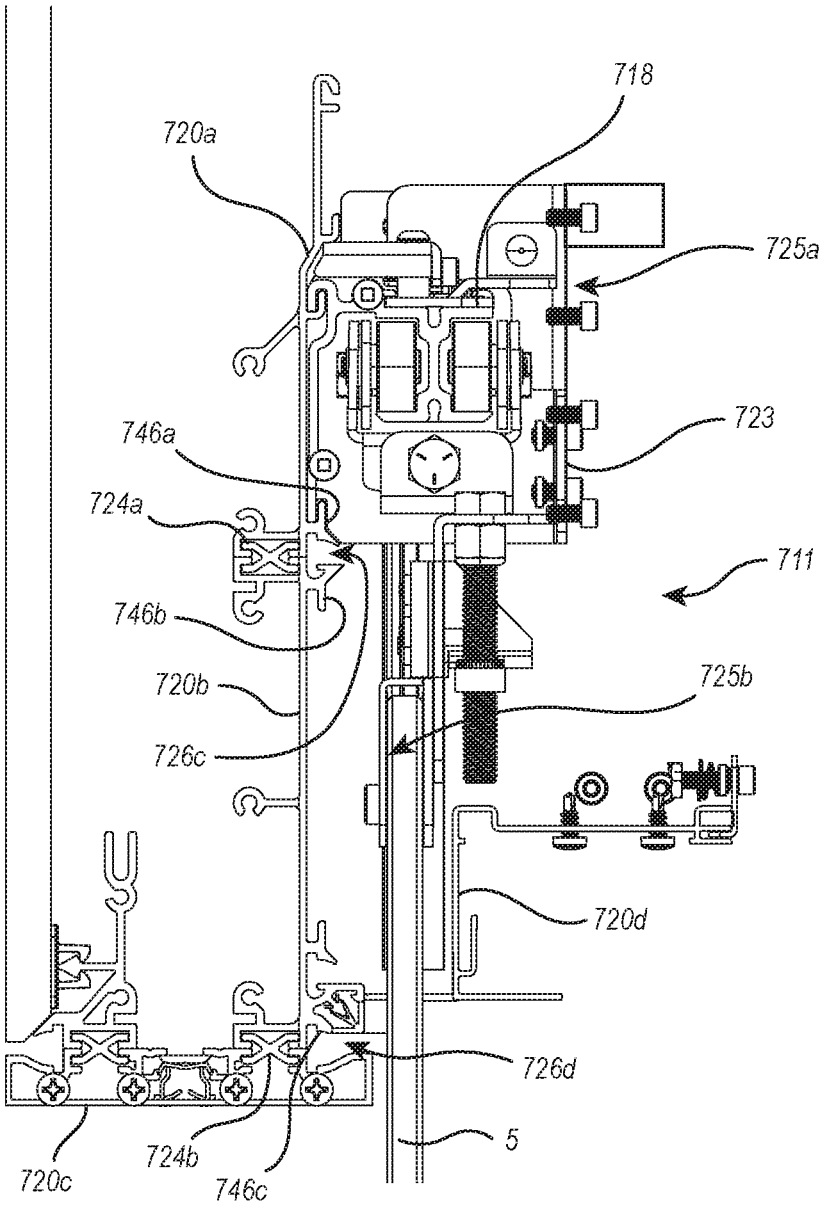
FIG. 7B illustrates a cross-sectional view of the embodiment of a mounting assembly illustrated in FIG. 7A.

One will appreciate that the dual roller track system illustrated in FIGS. 7A and 7B provides additional support to the door 5 secured to the roller bracket 723. The weight of the door 5 and roller bracket 723 is distributed between the two rollers 722*a*, 722*b*. In addition, a rotational force caused by the door 5 being offset from the track 718, which force would tend to push the rollers 722*a*, 722*b* out of their respective roller channels 721*a*, 721*b*, is reduced because of the dual roller channel 721*a*, 721*b* configuration illustrated. One or more embodiments may include one or more rollers in each roller channel 721*a*, 721*b*. For example, one embodiment may include two rollers in one roller channel and two rollers in the other roller channel. One or more embodiments may include more than three or four rollers in each roller channel. One embodiment of the dual roller track system may include eight total rollers 722, with four rollers in one roller channel 721*a* and four rollers in the other roller channel 721*b*.

Along these lines, one embodiment of the roller track system illustrated in FIG. 7A includes a pivot point 723 that an installer can adjust to level the plurality of rollers 722 about an axis that is parallel to the roller channels 721*a*, 721*b*. That is, the pivot point 723 can be adjusted to rotate the track 718 about its longitudinal axis so that the plurality of rollers 722 is centered above the door 5 and the weight between the eight rollers 722*a* is evenly distributed. Specifically, by adjusting the pivot point 723 or by freely pivoting due to the door weight alone, an installer can evenly distribute the weight of the door 5 between the two sets of rollers 722 in respective roller channels 721*a*, 721*b*.

In addition, one embodiment may include a second pivot point (not shown in FIG. 7A) that an installer can similarly adjust to level the track 718 about an axis that is horizontal and perpendicular to the longitudinal axis of the track 718. In this way, or by freely pivoting due to the door weight alone, an installer can distribute the weight of the door 5 between the plurality of rollers 722 within each roller track 721*a*, 721*b*. Also, in one or more embodiments, leveling screws 719 may additionally be provided. The leveling screws 719 secure to the roller bracket 723, which secures the door 5 therein, so that an installer can adjust the leveling screws 719 to ensure that the door 5 is level within the system.

The multiple components that an installer can manipulate to level the door 5 and distribute weight evenly across the rollers 722 provides a number of advantages. For example, distributing weight amongst the rollers 722 reduces resistance and wear in rollers 722 that would otherwise be overburdened with weight. The reduced resistance, in turn, aids in the performance of any soft close mechanisms or slow down mechanisms that may be incorporated into one or more embodiments of the present disclosure.

As described above with reference to FIG. 5, one or more embodiments may include a lock assembly. FIG. 7A illustrates an embodiment that includes lock assembly 729 attached at a lock bracket 727. The lock assembly 729 may be disposed such that a shroud (not shown in FIG. 7A) hides the lock assembly 729 therein to block it from view. In this way, bulky components such as the lock assembly 729, as well as other components of roller track systems described herein, can be neatly hidden from view above the ceiling to provide an aesthetically pleasing, visually uncluttered, and simple system to the end user.

In addition, the various components of roller track systems described herein may be configured such that an installer can install systems configured opposite one another using the same parts. For example, an installer can install the system illustrated in FIG. 7A so that the lock assembly 729 is on the right and the door 5 opens from the right to the left (from a perspective inside the room 1). The installer can then use the same component parts described herein to install a system where the lock assembly 729 is on the left and the door 5 opens from the left to the right.

FIG. 7B illustrates a cross-sectional view of the mounting assembly 711 illustrated in FIG. 7A. FIG. 7B illustrates the same components of the assembly 711 shown in FIG. 7A, but more clearly illustrates additional accessory channels 726*c*, 726*d* formed at the connection interfaces of the various connection components 720*a*, 720*b*. FIG. 7B also illustrates a ceiling perimeter module 720*d*, which includes a lower horizontal arm on which a ceiling panel may rest and a lower vertical arm to which a ceiling panel may be attached. For example, as discussed above, the first and second connection components 720*a*, 720*b* are secured together at a connection interface via the first interface component 724*a*. The first and second connection components 720*a*, 720*b* include respective extension arms 746*a*, 746*b*, which when brought together at the connection interface via the interface component 724*a*, form an accessory channel 726*c*. Likewise, another accessory channel 726*d* is formed from another extension arm 746*c* at the lower end of the second connection component 720*b* at a connection interface secured by a second interface component 724*b*. The accessory channels 726*c*, 726*d* can be used to secure additional components of the assembly therein, similar to the way the track 618 is secured to the connection component 620 via the accessory channel 626*a*, as shown in FIG. 6.

The implementation of the mounting assembly 711 illustrated in FIGS. 7A and 7B may be used to accommodate smaller ceiling spaces above the ceiling tiles of a modular wall system. For example, the mounting assembly 711 illustrated in FIGS. 7A and 7B may be configured to accommodate a vertical space above the ceiling of less than about one foot. In one implementation, the mounting assembly 711 is configured to accommodate a vertical space above the ceiling of less than about nine-inches. In yet another embodiment, the mounting assembly 711 is configured to accommodate a vertical space above the ceiling of about eight-inches or less.

Also, the mounting system 711 illustrated in FIGS. 7A and 7B simplifies manufacturing, construction, and assembly, making installation quick and easy. The mounting systems described herein allow for track repositioning after assembly and eliminates loose fasteners to speed installation and ensure proper fasteners are used. The mounting assembly 711 illustrated in FIGS. 7A and 7B allows for non-sequential assembly and disassembly steps. That is, a manufacturer can assemble the mounting assembly 711 illustrated in FIGS. 7A and 7B in different orders.

The embodiment illustrated in FIG. 7B also includes a door-opening header 720*c*. The door-opening header 720*c* provides a level, horizontal surface at the door opening. In addition, the door-opening header 720*c* forms accessory channel 726*d* between the door opening header 720*c* and the second connection component 720*b* at the interface therebetween. As noted above, accessory channel 726*d* can be used to secure additional components of the assembly therein, similar to the way the track 618 is secured to the connection component 620 via the accessory channel 626*a*, as shown in FIG. 6.

Figure 7C:
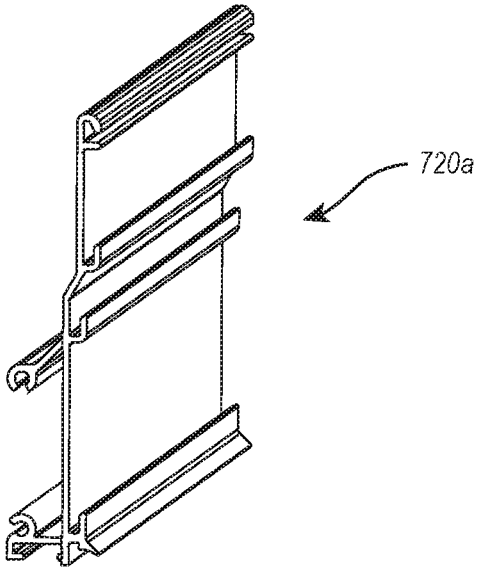
FIG. 7C illustrates a perspective view of the first connection component illustrated in FIG. 7A.
Figure 7D:
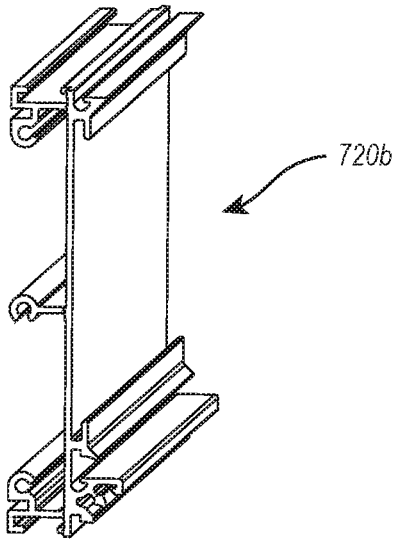
FIG. 7D illustrates a perspective view of the second connection component illustrated in FIG. 7A.
Figure 7E:
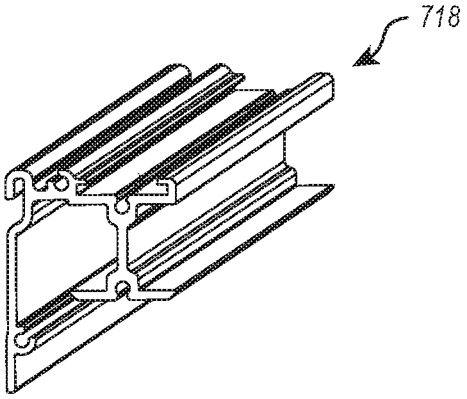
FIG. 7E illustrates a perspective view of the track illustrated in FIG. 7A.
Figure 7F:
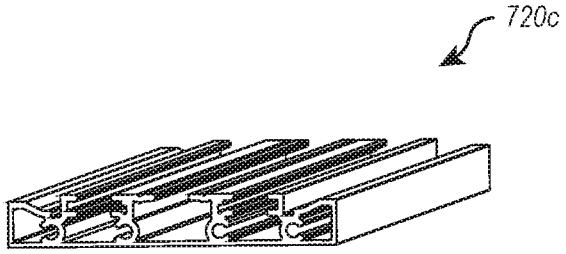
FIG. 7F illustrates a perspective view of the door-opening header illustrated in FIG. 7B.
Figure 7G:
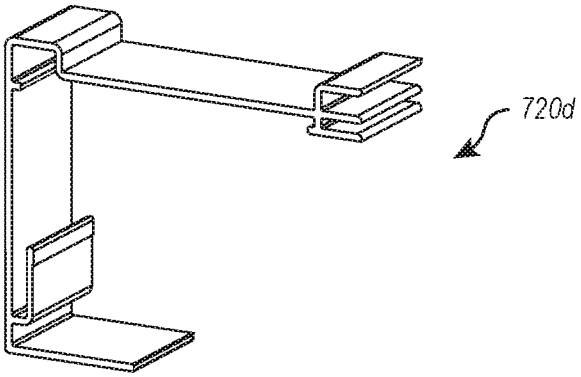
FIG. 7G illustrates a perspective view of the ceiling perimeter module illustrated in FIG. 7B.

In order to more clearly illustrate the various components of the system illustrated in FIGS. 7A and 7B, FIGS. 7C through 7F illustrate the connection components 720*a*, 720*b*, track 718, and door opening header 720*c*, which have been isolated from the system. In particular: FIG. 7C illustrates a perspective view of the first connection component 720*a* illustrated in FIG. 7A; FIG. 7D illustrates a perspective view of the second connection component 720*b* illustrated in FIG. 7A; FIG. 7E illustrates a perspective view of track 718 illustrated in FIG. 7A; FIG. 7F illustrates a perspective view of the door-opening header 720*c* illustrated in FIG. 7B; and FIG. 7G illustrates a perspective view of the ceiling perimeter module illustrated in FIG. 7B.

One will appreciate that the various accessory channels, arms, connection interface portions, and other features of the extruded components illustrated in FIGS. 7C through 7F, are formed from the contours of the extruded material. As such, these various features may be added, reconfigured, or relocated along the components to meet the need of a particular system or embodiment described herein by changing the contours of the extruded material during the manufacturing and design processes.

Figure 8A:
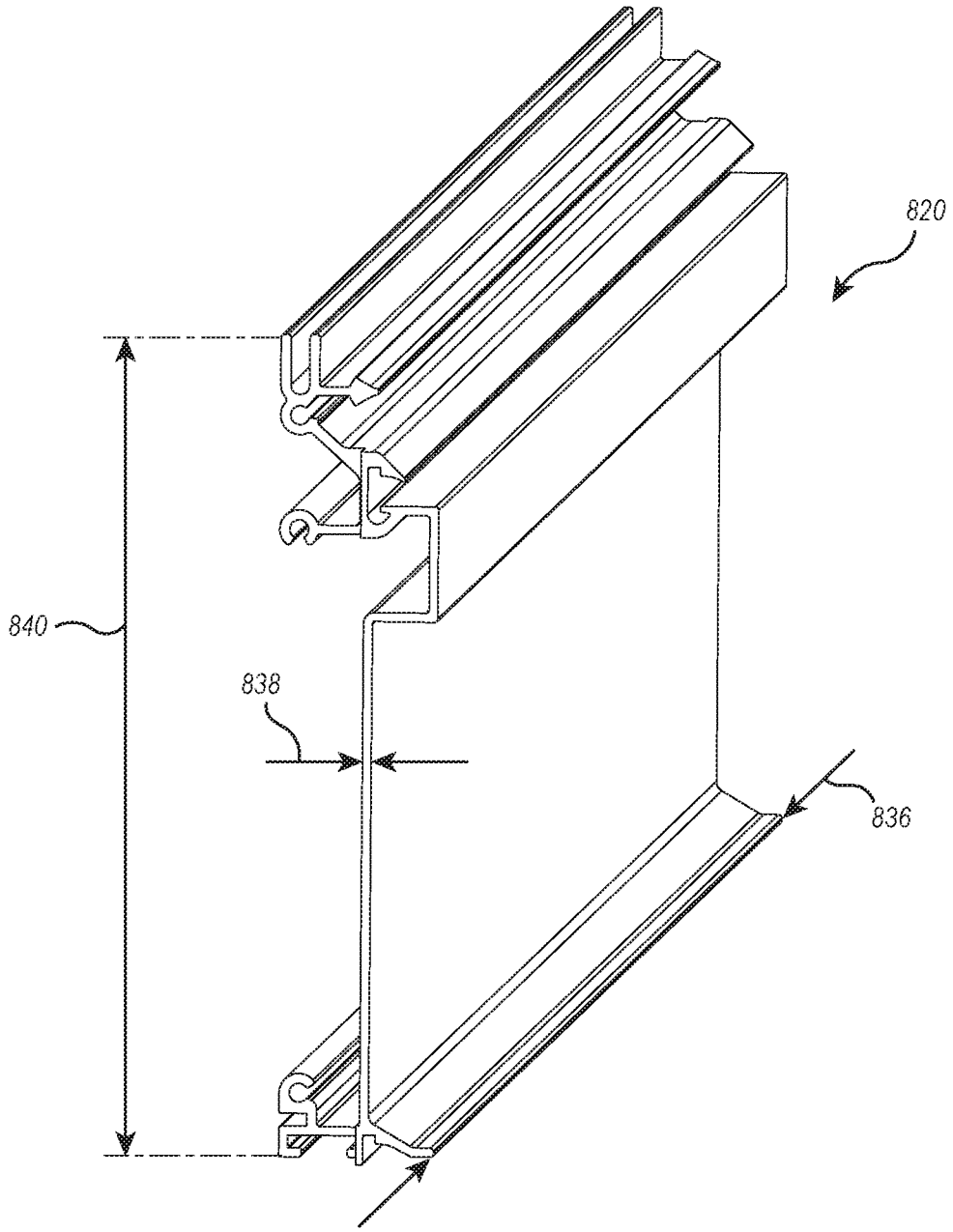
FIG. 8A illustrates a perspective view of a connection component.
Figure 8B:
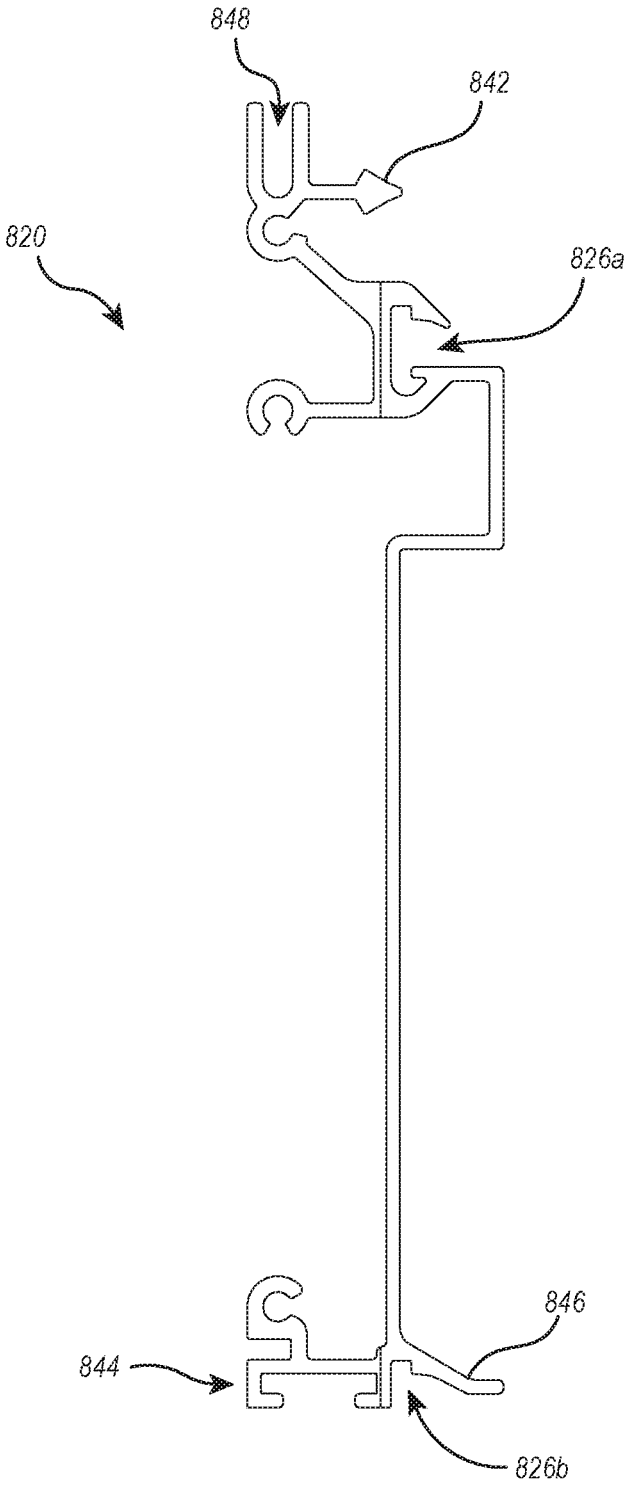
FIG. 8B illustrates a cross-sectional view of the connection component illustrated in FIG. 8A.

Along these lines, FIGS. 8A and 8B illustrate a connection component 820 substantially similar to the connection components illustrated in FIGS. 4 through 6 and described herein. FIG. 8A is a perspective view and FIG. 8B is a cross-sectional view of the connection component 820 illustrated in FIG. 8A.

The connection component 820 illustrated in FIG. 8A has an extrusion length 836. The extrusion length 836 may vary depending on the needs and/or configuration of the mounting assembly. The connection component also has a material thickness 838 that may be constant or vary throughout the cross-section and/or length of the connection component 820. Some portions of the connection component 820 may require a greater thickness 838 to accommodate higher stresses and/or stress concentrations due to the connection component 820 geometry and/or applied loads. Other portions of the connection component 820 may be thinner where lower stresses are present, to reduce material costs, and/or to decrease weight. FIG. 8A also illustrates a total connection component 820 and height 840.

The height 840, thickness 838, and/or length 836 of the connection component 820 or its individual contours and/or features may vary depending on the requirements of the modular wall system. For example, the height 840, thickness 838, and length 836 of component 820 illustrated in FIG. 8A can also apply to components that are shown and described in reference to FIGS. 7A-7F above.

As can be seen in FIG. 8B, the illustrated embodiments of the connection component 820 includes an interface element 844, a first accessory channel 826*a*, at least a first portion of a second accessory channel 826*b*, and one or more attachment elements 842. An installer may use the one or more attachment elements 842 to attach modular wall panels, tiles, or other modular wall system components to the connection component 820.

In one implementation, the interface element 844 is configured to be aligned with and/or removably secured to an interface element of a second connection component (not illustrated) to form a modular structure. In such an implementation, an attachment interface is formed where the two interface elements 844 of the two connection components meet. Also, in one implementation, the second connection component forms a second portion of the second accessory channel 826*b* when the two connection components are secured together at the attachment interface.

A cross-sectional shape and/or contours of the connection component 820 define the first accessory channel 826*a* within the connection component 820. An installer or user may insert accessories or accessory mounting mechanisms (e.g., cantilever arm 429 of track connection bracket 428) in the first accessory channel 826*a*. Similarly, the cross-sectional shape and/or contours of the connection component 820 also define the portion of the second accessory channel 826*b*. An installer can connect the connection component 820 to another connection component, door-opening header module, or other modular wall system component to fully form or define the second accessory channel 826*b*. An extension arm 846 extends from the connection component 820 to partially define the second accessory channel 826*b*.

Connection component 820 also includes a receptacle 848 that can receive fasteners therein to enable a shroud to be connected to the connection component. The receptacle 848 may take various forms. For instance, the receptacle 848 may be a channel into which a fastener or portion of a shroud may be disposed. Similarly, the receptacle 848 may include a plurality of discreet receptacles configured to receive multiple fasteners or portions of a shroud. Thus, both a track connection bracket and a shroud can be connected to the connection component 820 near the same (upper) end to support a sliding door and a suspended ceiling.

Connection component 820, and any other component described herein, including but not limited to tracks, roller brackets, track connection components, cantilever arms, and/or other components according to the present disclosure may be solid, uniform, unitary, seamless, and/or extruded. One will appreciate in light of the disclosure herein that these components may be fabricated, manufactured, formed, extruded, and/or comprised of any suitable material, including aluminum, steel, and/or other types of metal and/or metal alloy, as well as any other suitable synthetic and/or natural material, or any suitable combination thereof.

One will appreciate that systems according to various implementations of the present disclosure can be oriented in any suitable orientation, including diagonal, vertical or substantially vertical, and/or horizontal or substantially horizontal, wherein the term "substantially" indicates allowable, acceptable, or other deviation(s) from a perfect or other precise orientation. For instance, a substantially vertical orientation can account for small imperfections or errors in the assembly, construction, and/or formation of an upright divider or other wall system, including assembling, mounting, constructing, or otherwise assembling the modular wall system.

Furthermore, an installer can arrange and/or re-arrange a plurality of wall modules into a plurality of configurations resulting in a wall or other barrier, divide, structure or structural component that includes the sliding door mounting systems of the present disclosure. For instance, an installer may switch the relative positions of walls illustrated in any of the figures described herein to allow for versatility in aesthetic or other design properties. Indeed, the design and/or components of a modular wall system including a sliding door mounting system may allow for an installer to place, position, secure, and/or arrange any wall module in any position, orientation, and/or configuration available within the system. For instance, one module may be interchangeable, re-arrangeable, and/or replaceable by or with any other module.

The implementation of additional components and/or features known in the art and/or desirable in certain implementations of the present disclosure will be apparent to those skilled in the art and/or in light of the present disclosure. For instance, certain implementations may include acoustic and/or other tiles or panels mounted to, about, and/or within components, modules, subunits, walls, and/or systems disclosed herein. Furthermore, the absence of such known or apparent features should not be construed as restricting the scope or application of the present disclosure to the exclusion of such features.

The above-described implementations of the present disclosure are meant to be illustrative of example implementations and are not intended to limit the scope of the present disclosure. Various modifications, which would be readily apparent to one skilled in the art, are intended to be within the scope of the present disclosure. The only limitations to the scope of the present disclosure are set forth in the following claims appended hereto.

It is also understood that various implementations described herein may be utilized in combination with any other implementation described, without departing from the scope contained herein. Therefore, products, members, elements, devices, apparatus, systems, methods, and/or processes according to certain implementations of the present disclosure may include, incorporate, or otherwise comprise properties, features, components, members, elements, steps, and/or the like described in other implementations (including systems, methods, apparatus, and/or the like) disclosed herein without departing from the scope of the present disclosure. Thus, reference to a specific feature in relation to one implementation should not be construed as being limited to applications only within said implementation.

The present disclosure may be embodied in other specific forms without departing from its spirit or essential characteristics. The described implementations are to be considered in all respects only as illustrative and not restrictive. The scope of the invention is, therefore, indicated by the appended claims rather than by the foregoing description. While certain implementations and details have been included herein and in the attached disclosure for purposes of illustrating the invention, it will be apparent to those skilled in the art that various changes in the methods and apparatus disclosed herein may be made without departing from the scope of the invention, which is defined in the appended claims. All changes which come within the meaning and range of equivalency of the claims are to be embraced within their scope.

We claim:

1. A system for mounting sliding doors within a wall system, the system comprising:

a connection component defining a first accessory channel and a receptacle adjacent to a first end thereof, a track secured to the connection component via a cantilever arm extending into the first accessory channel;

a roller in communication with the track;

a ceiling support rail;

a roller bracket connected to the roller at a first end and connected to a sliding door panel at a second end; and a shroud that substantially encases the track, roller, and roller bracket, the shroud having an upper end connectable to the connection component via the receptacle and a lower end connectable to the ceiling support rail, wherein the ceiling support rail supports one or more components of a suspended ceiling, and wherein the connection component, track, roller, and roller bracket are disposable above the suspended ceiling.

2. The system of claim 1, wherein the shroud is sized and positioned to substantially block light from traveling through the system from above the ceiling to below the ceiling.

3. The system of claim 1, further comprising a track connection bracket, wherein the track connection bracket connects the track to the connection component, the track connection bracket being configured to secure to the track at a first end and secure to the connection component at a second end via a track connection bracket cantilever arm.

4. The system of claim 1, further comprising a door-opening header module.

5. The system of claim 1, wherein the ceiling support rail is directly connected to the connection component.

6. The system of claim 1, further comprising a slit opening through which the door vertically extends.

7. The system of claim 6, wherein the one or more components of the suspended ceiling are mounted to the ceiling support rail such that the suspended ceiling is flush with a ceiling on an opposing sides of the slit opening.

8. A sliding door mounting system, comprising:

a first connection component defining a first accessory channel and a second accessory channel disposed below the first accessory channel;

a track secured to the connection component via a first arm extending into the first accessory channel and a second arm extending into the second accessory channel, wherein the track comprises first and second roller channels;

first and second rollers in communication with the first and second roller channels, respectively;

a ceiling support rail;

a roller bracket connected to the first and second rollers at a first end and connected to a door at a second end; and a shroud that substantially encases the track, roller, and roller bracket, the shroud having an upper end connectable to the first connection component and a lower end connectable to the ceiling support rail.

9. The system of claim 8, wherein the shroud is configured to have a suspended ceiling connected to a lower end thereof via the ceiling support rail, and wherein the first and second connection components, track, rollers, and roller bracket are disposable above the suspended ceiling.

10. The system of claim 9, wherein the mounting system is configured to be disposed within a space above the suspended ceiling that is less than about a foot in vertical height.

11. The system of claim 9, wherein the shroud is sized and positioned to block light from traveling through the mounting system from above the suspended ceiling to below the suspended ceiling.

12. The system of claim 8, wherein the shroud is sized and positioned to hide the connection components, track, rollers, and roller bracket from view.

13. The system of claim 8, wherein the first connection component is selectively secured to a second connection component at a connection interface via an interface component.

14. The system of claim 13, the first connection component comprising a first extension arm and the second connection component comprising a second extension arm, wherein a third accessory channel is formed between the first and second extension arms when the first and second connection components are secured together at the connection interface via the interface component.

15. The system of claim 8, wherein the ceiling support rail supports one or more ceiling components.

16. The system of claim 6, wherein the shroud is sized and positioned to substantially block light from travelling through the slit opening from above the ceiling to below the suspended ceiling.

17. The system of claim 4, wherein the door-opening header module is connected to a second end of the connection component, the door-opening header module having a lower surface that is substantially co-planar with the suspended ceiling.

18. The system of claim 8, further comprising a pivot point configured to rotate the track about a longitudinal axis to adjust a position of the first and second rollers relative to the door.

19. The system of claim 8, further comprising one or more leveling screws secured to the roller bracket, the one or more leveling screws being operable to adjust a level of the door by adjusting a relative position of the roller bracket.

* * * * *